US006544373B2

(12) United States Patent
Chen et al.

(10) Patent No.: US 6,544,373 B2
(45) Date of Patent: Apr. 8, 2003

(54) POLISHING PAD FOR A CHEMICAL MECHANICAL POLISHING PROCESS

(75) Inventors: Hsueh-Chung Chen, Taipei Hsien (TW); Teng-Chun Tsai, Hsin-Chu (TW)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 09/682,137

(22) Filed: Jul. 26, 2001

(65) Prior Publication Data

US 2003/0019570 A1 Jan. 30, 2003

(51) Int. Cl.[7] ..... B32B 31/00; B24D 17/00

(52) U.S. Cl. ..... 156/252; 15/209.1; 451/526; 451/528; 451/529; 451/533; 156/257; 156/263; 156/268; 156/293

(58) Field of Search ..... 156/252, 257, 156/263, 268, 513, 293; 451/526, 528, 529, 533; 15/209.1; 428/139

(56) References Cited

U.S. PATENT DOCUMENTS 3,507,739 A * 4/1970 Jacobs ..... 428/139
4,274,232 A * 6/1981 Wylde ..... 451/490
5,609,517 A * 3/1997 Lofaro ..... 451/529

* cited by examiner

*Primary Examiner*—Linda Gray
(74) *Attorney, Agent, or Firm*—Winston Hsu

(57) ABSTRACT

The present invention gives a method of fabricating a composite polishing pad. A first polishing pad has a glue layer on a surface of the first polishing pad and a number of hard polishing materials positioned on the glue layer. Then portions of the first polishing pad are punched off to remove portions of the hard polishing material positioned on the surface of the first polishing pad so as to form holes penetrating the first polishing pad. A second polishing pad has a glue layer on a surface of the second polishing pad, and soft polishing materials adhere to the glue layer. Then portions of the soft polishing material positioned on the surface of the second polishing pad are removed while retaining the glue layer, and the portions of the soft polishing material retained on the surface of the second polishing pad completely match the holes formed in the first polishing pad. Finally, the first polishing pad is stuck on the surface of the second polishing pad so as to form a composite polishing pad having a pattern formed by the hard and soft polishing materials on the surface of the composite polishing pad.

12 Claims, 13 Drawing Sheets

POLISHING PAD FOR A CHEMICAL MECHANICAL POLISHING PROCESS

BACKGROUND OF THE INVENTION

1. Field of the Invention

The present invention relates to a method of fabricating a composite polishing pad for a chemical mechanical polishing process.

2. Description of the Prior Art

Chemical mechanical polishing (CMP) is a method of polishing materials, such as a semiconductor wafer, to a high degree of planarity and uniformity. The process is used to planarize a semiconductor wafer prior to the fabrication of microelectronic circuitry thereon, and is also used to remove high-elevation features created during the fabrication of the microelectronic circuitry on the surface of the semiconductor wafer.

Please refer to FIG. 1. FIG. 1 is of a cross-sectional diagram of a semiconductor wafer 10. The semiconductor wafer 10 comprises a substrate 12, a conductive layer 14 positioned on the surface of the substrate 12 and a dielectric layer 16 positioned on the surface of the substrate 12. The dielectric layer 16 covers the conductive layer 14. Please refer to FIG. 2. FIG. 2 is of a perspective view of a chemical mechanical polishing apparatus 20. The chemical mechanical polishing apparatus 20 comprises a polishing table 22, a polishing pad 24 set on the polishing table 22, a holder 28 for pressing the semiconductor wafer 10 onto the polishing pad 24, a slurry supply apparatus 30 for supplying a slurry to polish the semiconductor wafer 10, and a conditioner 32 to control the distribution of the slurry on the polishing pad and to remove polished material that is formed during the polishing process.

Please refer to FIG. 3 and FIG. 4. FIG. 3 is a top view of the polishing pad 24, and FIG. 4 is a cross-sectional diagram of the polishing pad according to the prior art. The polishing pad 24 comprises three concentric circular grooves 26. The slurry drops from the slurry supply apparatus 30 to the surface of the polishing pad 24 and flows along the concentric circular grooves 26 so as to distribute the slurry over the surface of the polishing pad.

According to the prior art, the semiconductor wafer 10 is set in the holder 28 before performing the chemical mechanical polishing process. The back surface of the semiconductor wafer 10 is held by the holder 28 and the front surface of the semiconductor wafer 10 is pressed onto the surface of the polishing pad 24. During the chemical mechanical polishing process, the holder 28 rotates counterclockwise and moves to-and-fro, and the polishing table 22 also rotates counterclockwise. The relative motion of the semiconductor wafer 10 with the polishing pad 24 polishes the front surface of the semiconductor wafer 10. The surface of the semiconductor wafer 10 becomes globally planar after the chemical mechanical polishing process, as shown in FIG. 5.

Generally speaking, the polishing pads used in CMP of metal wire comprise hard (for example: IC-1000) and soft (for example: POLITEX) polishing pads. The former provides fast removal rate and great planarization effect, but the scratch problems isoccured. The latter can prevent scratch problems and provide a fine polishing effect and good cleaning performance, but the dishing problem of aluminum wire is induced. Therefore, in the prior CMP hard polishing pad is first used to polish the surface of the semiconductor wafer and then a soft polishing pad is used for further polishing so as to complete the planarization process. Two polishing processes are necessary to performed respectively, so both high time cost and consumption cost of polishing pads are required incurred resulting in a low efficiency of in the CMP.

SUMMARY OF INVENTION

It is therefore a primary objective of the present invention to provide a method of fabricating composite polishing pads used in chemical-mechanical process to solve the above-mentioned problems.

The present invention provides a method of fabricating a composite polishing pad. The method first provides a first polishing pad comprising a glue layer on a surface of the first polishing pad and a plurality of hard polishing materials positioned on the glue layer. Then portions of the first polishing pad are punched off to remove portions of the hard polishing material positioned on the surface of the first polishing pad so as to form a plurality of holes penetrating the first polishing pad. Thereafter, a second polishing pad comprising a glue layer on a surface of the second polishing pad is provided, and a plurality of soft polishing materials adhere to the glue layer. Then portions of the soft polishing material positioned on the surface of the second polishing pad are removed while retaining the glue layer, and the soft polishing material retained on the surface of the second polishing pad completely matches the holes formed in the first polishing pad. Finally, the first polishing pad is stuck on the surface of the second polishing pad so as to form a composite polishing pad comprising a pattern formed by the hard and soft polishing materials on the surface of the composite polishing pad.

The polishing pad fabricated by the present invention comprises a pattern formed by the hard and soft polishing materials on the surface of the polishing pad, so the composite polishing pad simultaneously providesa good removal rate and a great polishing effect. Only one polishing process is required to complete the planarization process, so the time and cost of the chemical-mechanical process is reduced.

DETAILED DESCRIPTION

Figure 1:
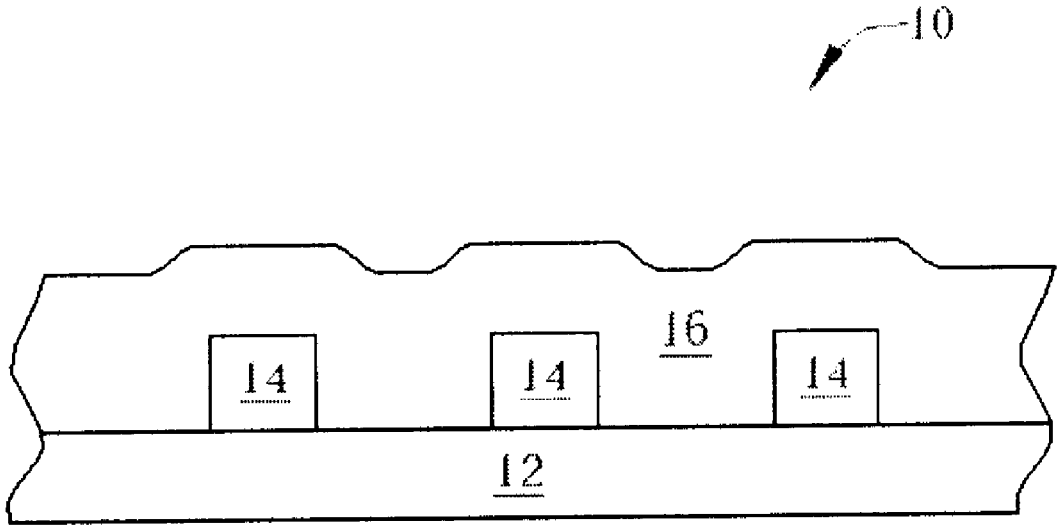
Fig. 1 Prior art
FIG. 1 is a cross-sectional diagram of a semiconductor wafer according to the prior art.
Figure 2:
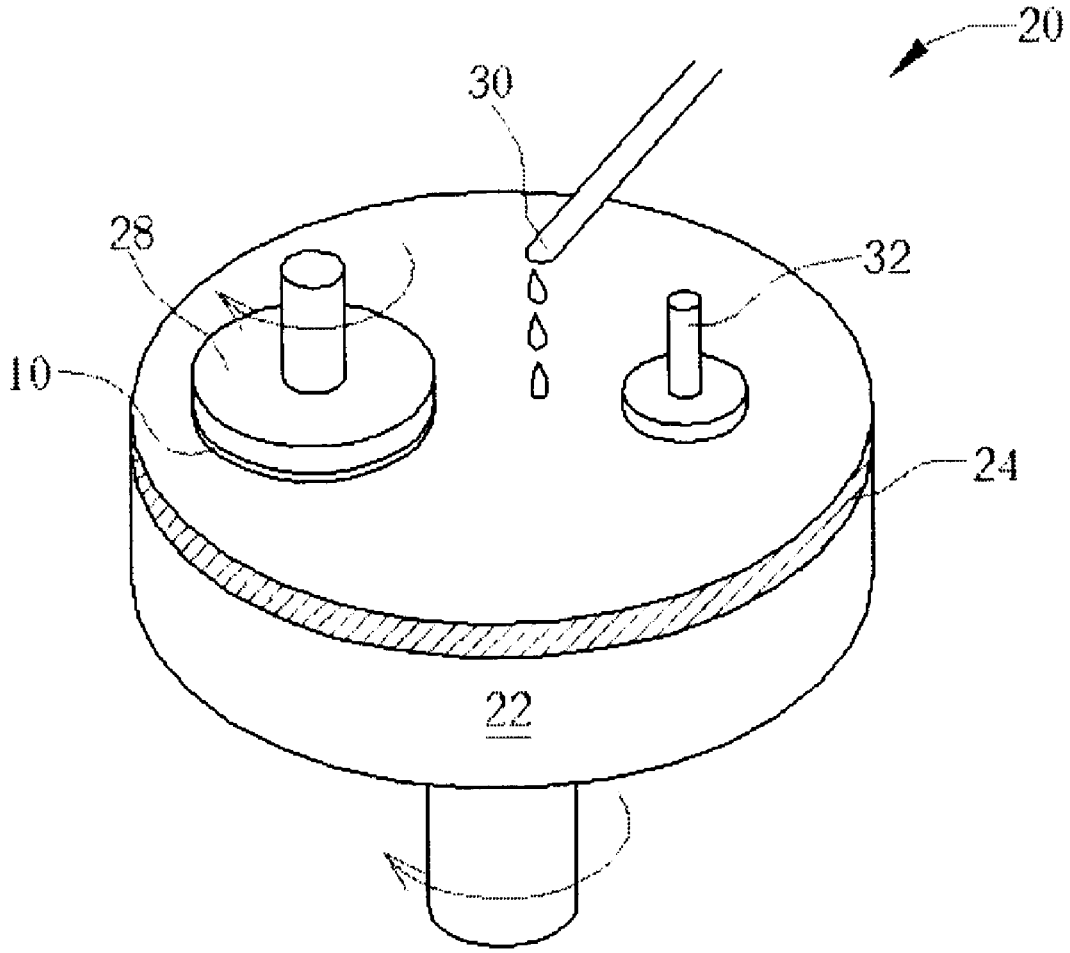
Fig. 2 Prior art
FIG. 2 is a perspective view of a chemical mechanical polishing apparatus according to the prior art.
Figure 3:
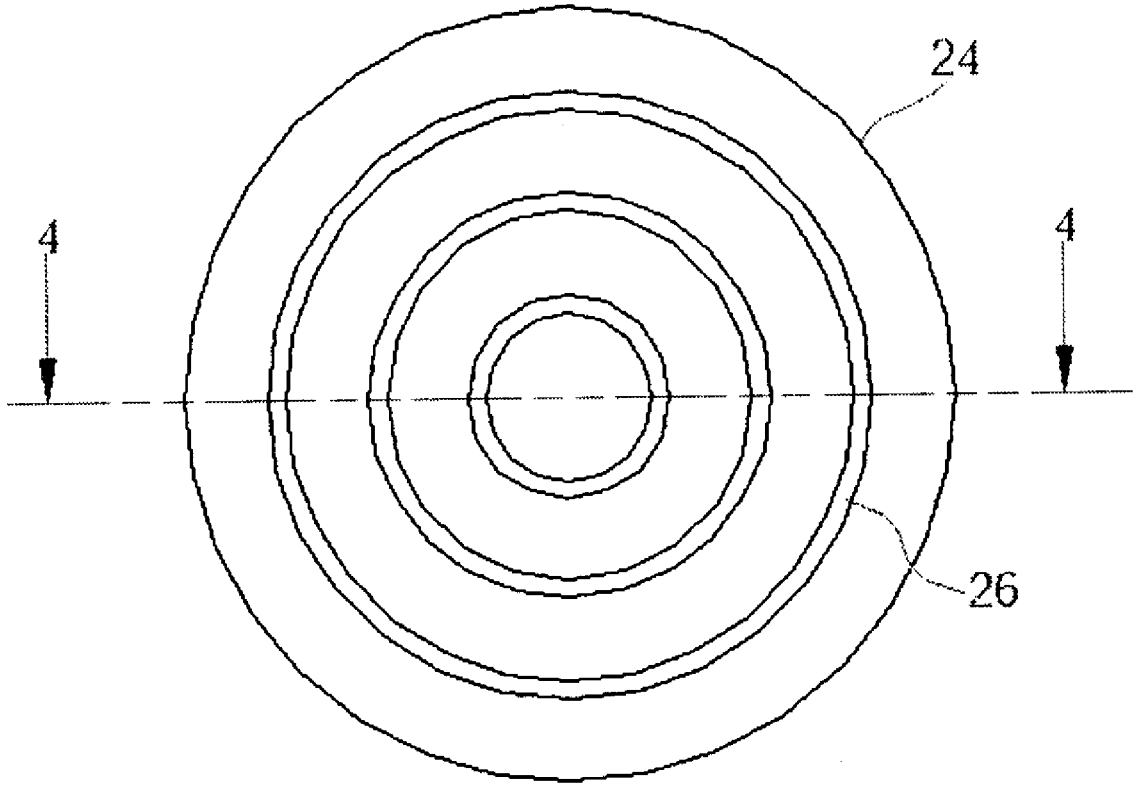
Fig. 3 Prior art
FIG. 3 is a top view of a polishing pad according to the prior art.
Figure 4:
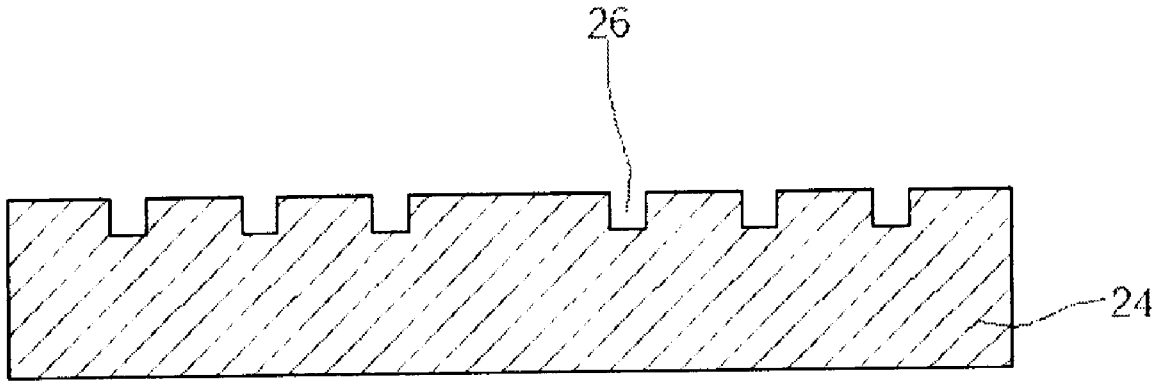
Fig. 4 Prior art
FIG. 4 is a cross-sectional diagram of the polishing pad of FIG. 3.
Figure 5:
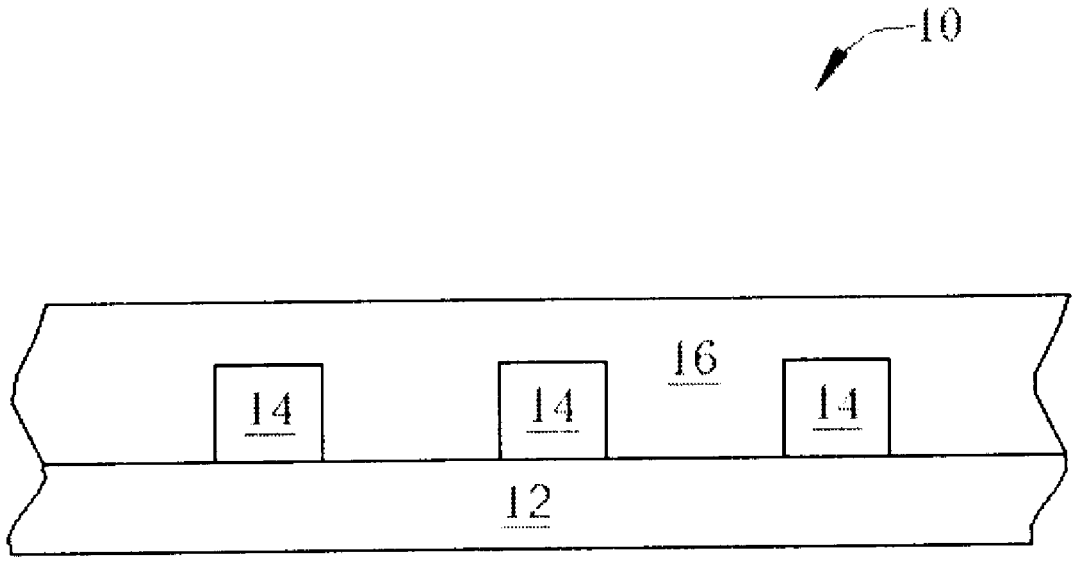
Fig. 5 Prior art
FIG. 5 is a cross-sectional diagram of a semiconductor wafer after a chemical mechanical polishing process.
Figure 6:
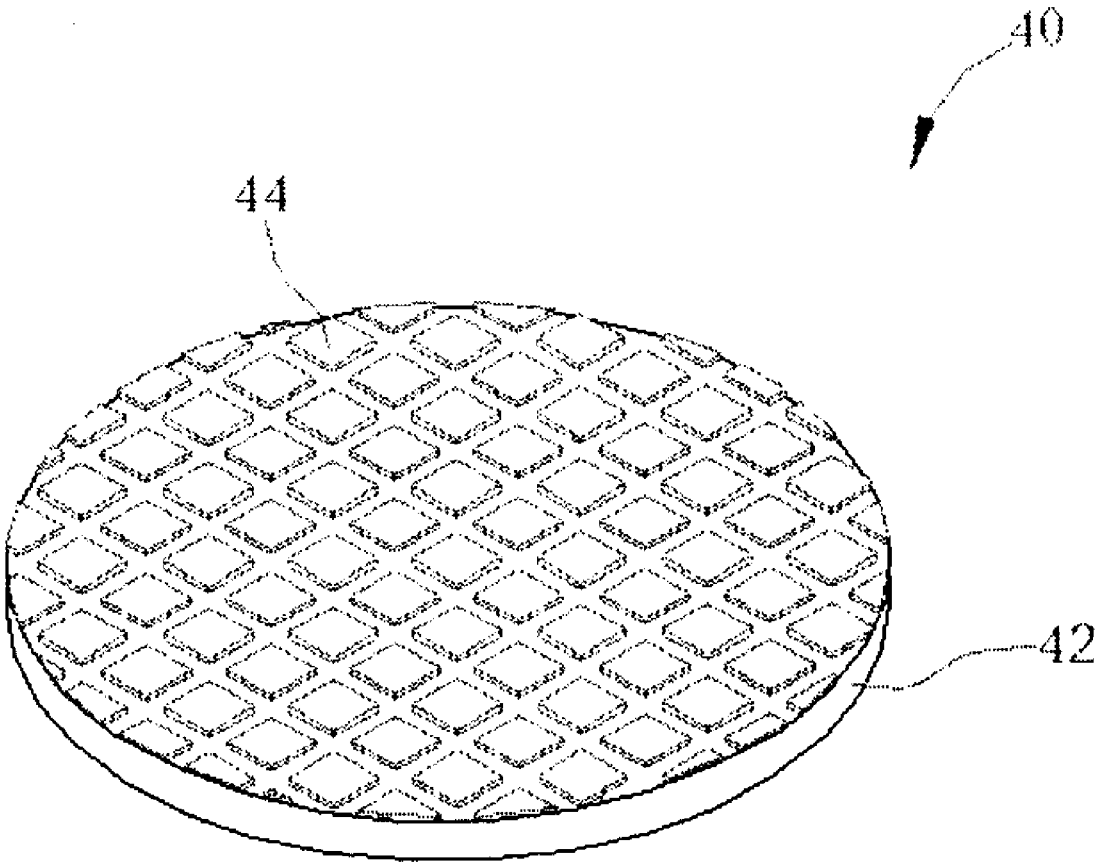
FIG. 6 to FIG. 10 are schematic diagrams of a method of fabricating the composite polishing pad according to the present invention.
Figure 7:
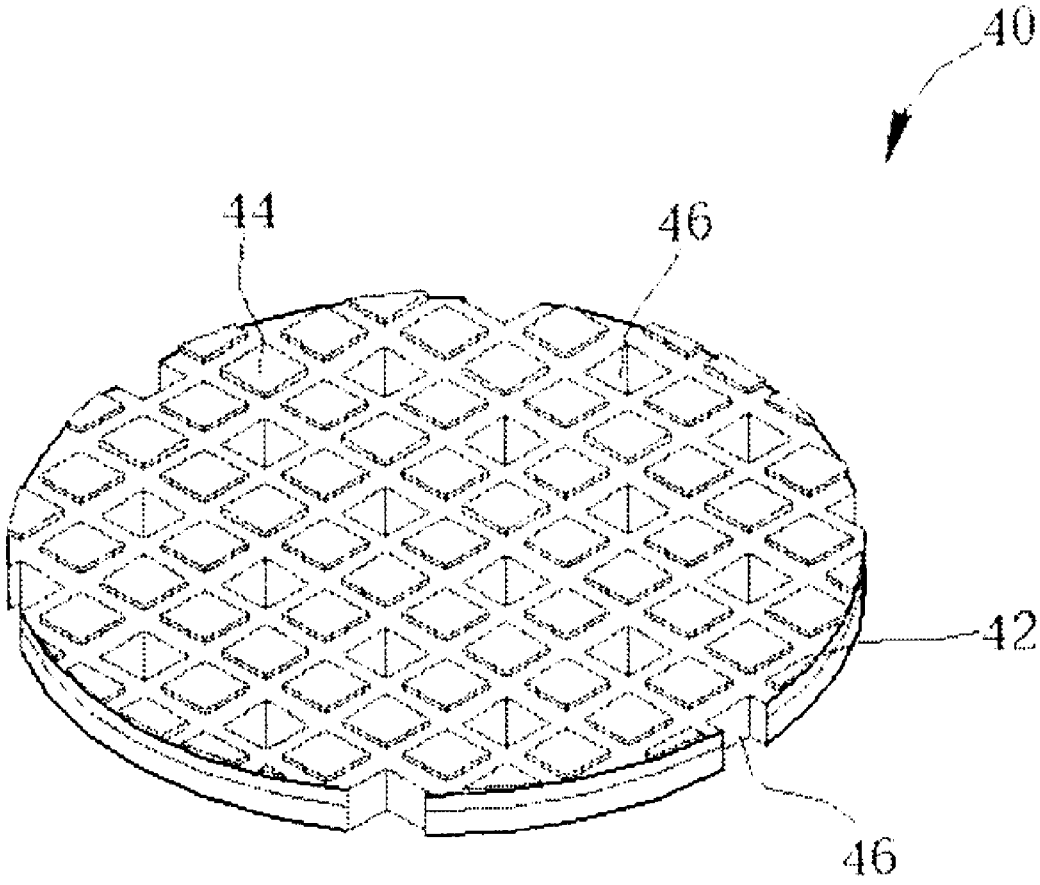

Please refer to FIG. 6 to FIG. 10 of schematic diagrams of a method for fabricating the composite polishing pad according to the present invention. As shown in FIG. 6, the present invention provides a first polishing pad 40 that comprises a glue layer 42 on a surface of the first polishing pad 40 and a plurality of hard polishing materials 44 positioned on the glue layer 42. Then as shown in FIG. 7, portions of the first polishing pad 40 are punched off to remove portions of the hard polishing material 44 positioned on the surface of the first polishing pad 40 so as to form a plurality of holes 46 penetrating the first polishing pad 40.

Figure 8:
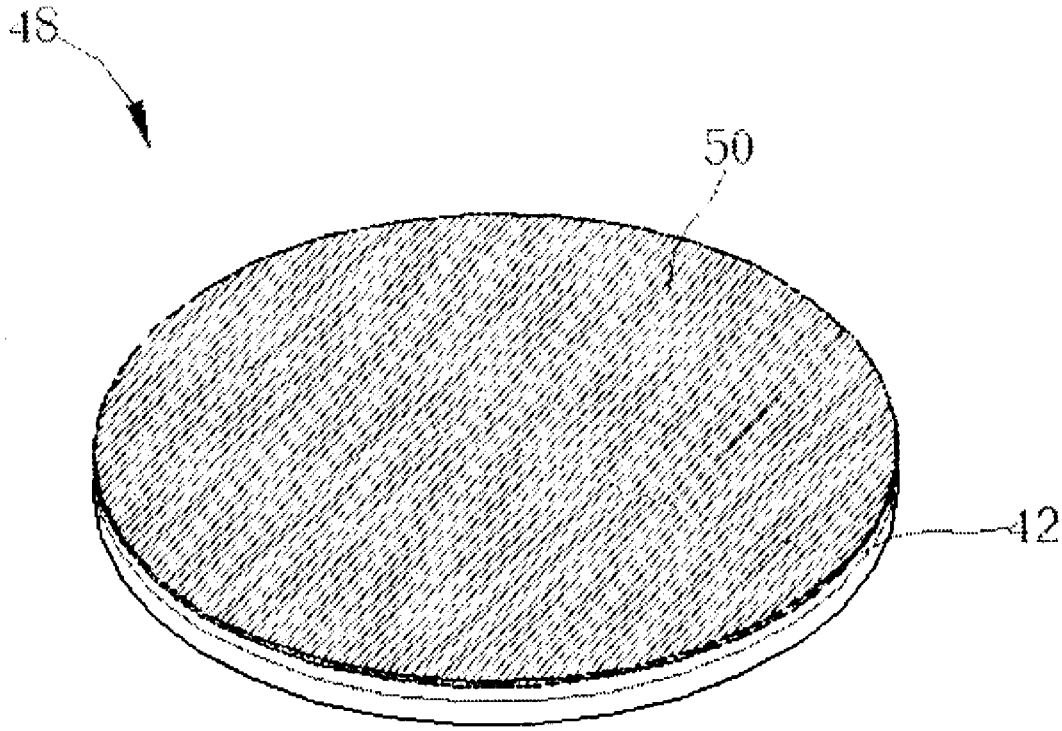
Figure 9:
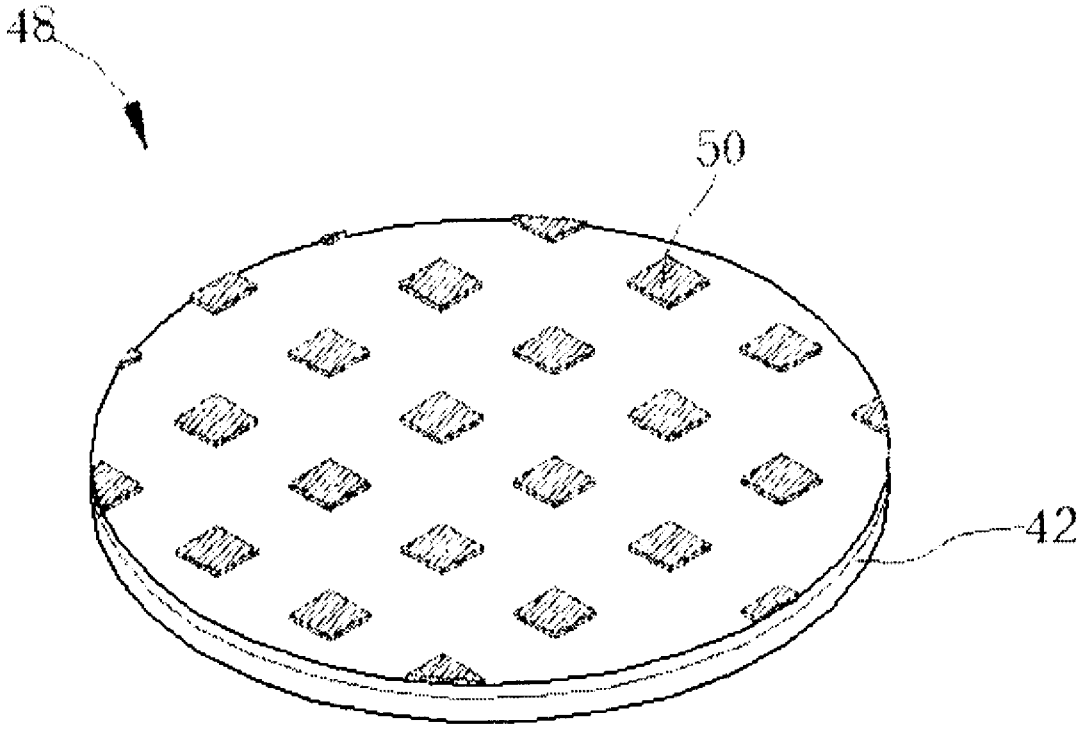

As shown in FIG. 8, a second polishing pad 48 is provided that comprises a glue layer 42 on a surface of the second polishing pad 48 and a plurality of soft polishing materials 50 adhering to the glue layer 42. Thereafter, as shown in FIG. 9, portions of the soft polishing materials 50 positioned on the surface of the second polishing pad 48 is removed while the glue layer 42 is retained. The soft polishing material 50 retained on the surface of the second polishing pad 48 completely match the holes 46 formed in the first polishing pad 40.

Figure 10:
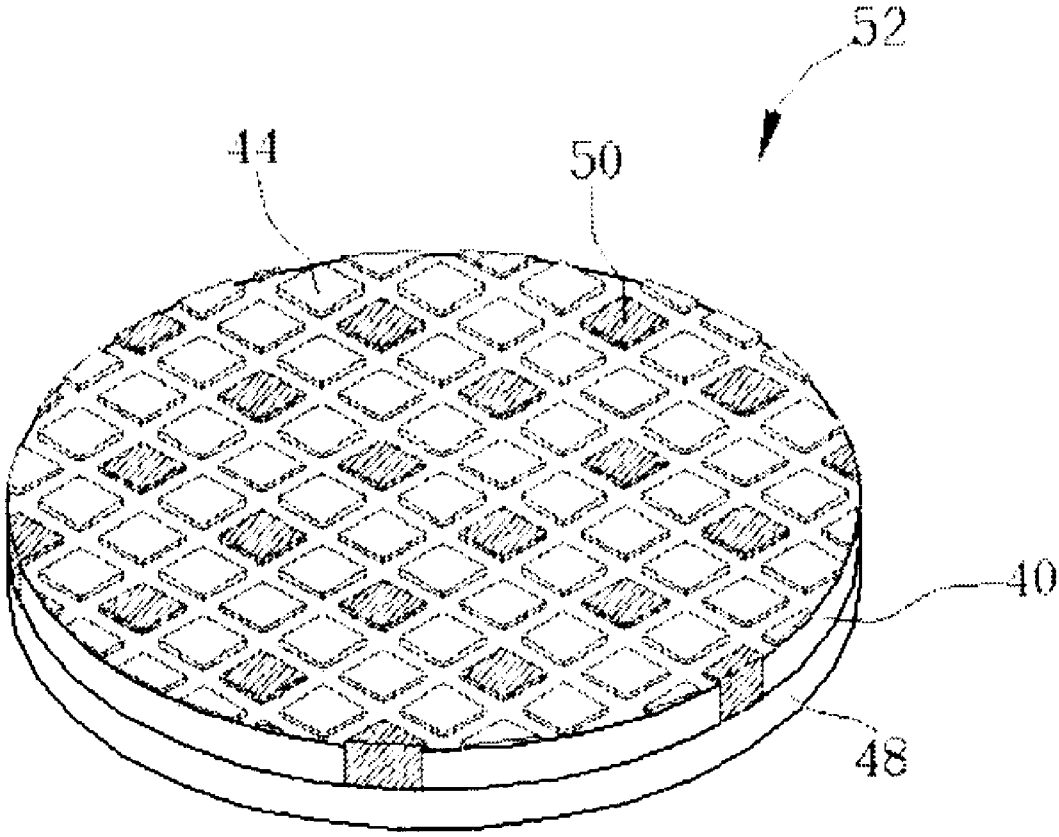

Finally, as shown in FIG. 10, the first polishing pad 40 is stuck on the surface of the second polishing pad 48 so as to form a composite polishing pad 52. According to the present invention to complete the above-mentioned process, the surface of the composite polishing pad 52 comprises a pattern formed by interlacing the hard 44 and soft 50 polishing materials along an X-axis and Y-axis of the surface of the composite polishing pad 52. Hence the composite polishing pad 52 provides both a great removal rate and a good polishing effect.

Figure 11:
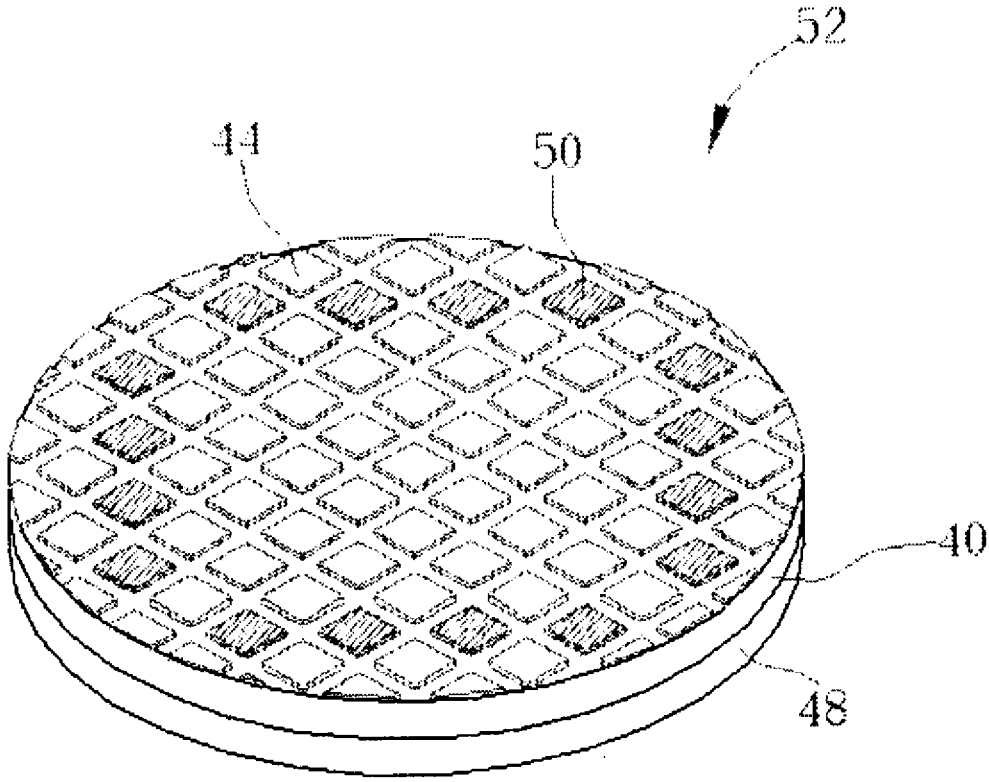
FIG. 11 to FIG. 13 are top views of the second, third and forth embodiments of composite polishing pads according to the present invention.
Figure 12:
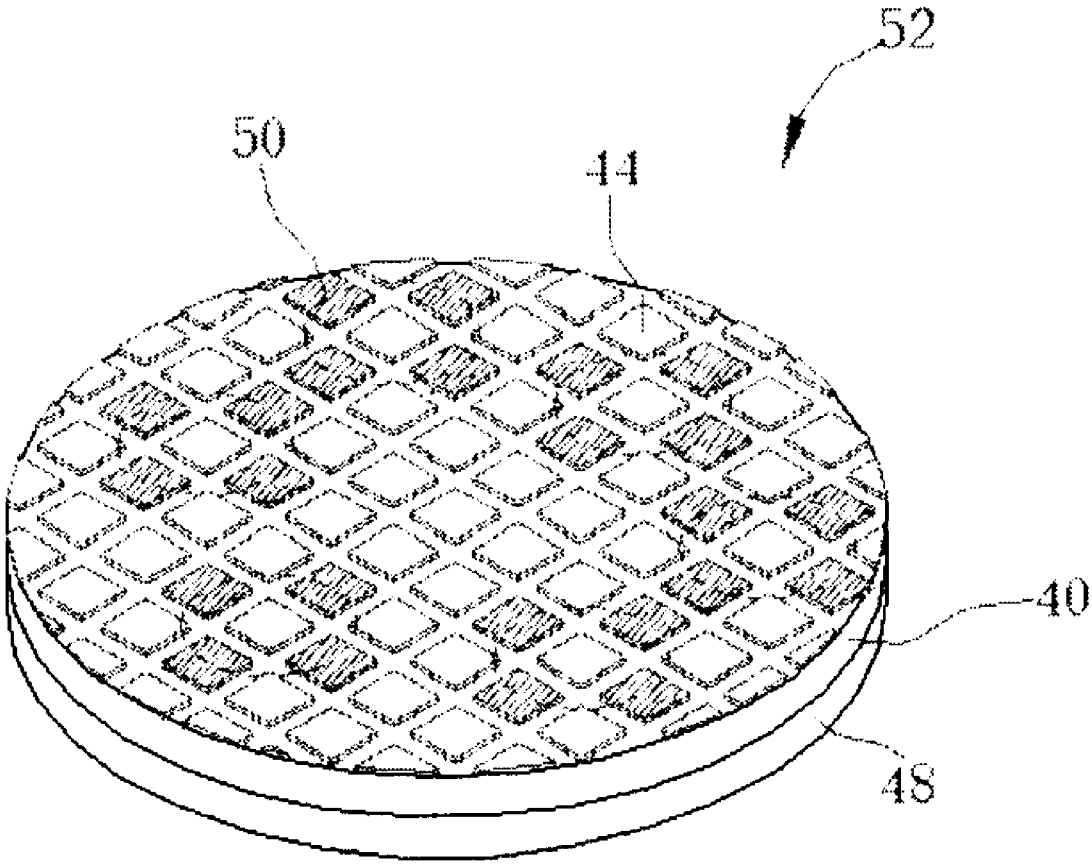
Figure 13:
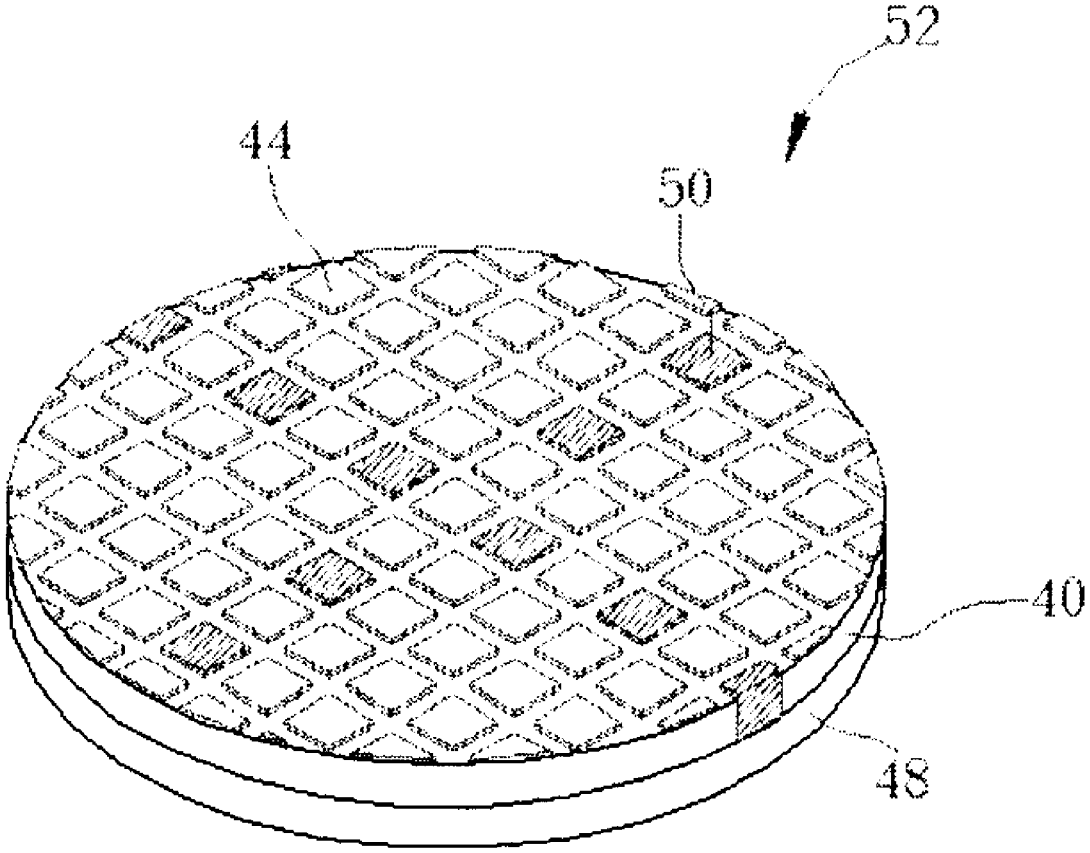

Please refer to FIG. 11 to FIG. 13 of top views of the second, third and forth embodiments of composite polishing pad according to the present invention. As shown in FIG. 11, the surface of the composite polishing pad 54 comprises a pattern formed by arranging hard 56 and soft 58 polishing materials in concentric circles with different radiuses on the surface of the composite polishing pad 54. As shown in FIG. 12, the surface of the composite polishing pad 60 comprises a pattern formed by respectively arranging hard 62 and soft 64 polishing materials as rings in concentric circles with different radiuses on the surface of the composite polishing pad 60. As shown in FIG. 13, the surface of the composite polishing pad 66 comprises a pattern formed by interlacing hard 68 and soft 70 polishing materials along radial directions on the surface of the composite polishing pad 66.

The composite polishing pad fabricated by the present invention, as shown in FIG. 10 to FIG. 14, which comprises both hard and soft polishing materials on the surface of the composite polishing pad. The area ratio of hard and soft polishing materials positioned on the surface of the composite polishing pad is used to adjust removal rate and improve the uniformity of the surface of a semiconductor wafer after being polished so as to improve the throughput. The complete composite polishing pad is set in a chemical mechanical polishing apparatus and the chemical mechanical polishing apparatus further comprises a conditioner to control a distribution of a slurry on the surface of the polishing pad and to remove polished material that is formed during the polishing process.

In contrast to the prior chemical-mechanical process, which performs an initial polishing process by hard polishing materials followed by using soft polishing materials for further polishing and completing the planarization process, the composite polishing pad fabricated by the present invention comprises a pattern formed by the hard and soft polishing materials on the surface of the composite polishing pad. The composite polishing pad provides both great removal rate and good polishing effect. Only one polishing process is required to complete the planarization process, so both the time and cost of the chemical-mechanical process are reduced.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method of fabricating a composite polishing pad, the method comprising:

providing a first polishing pad which comprises a glue layer on a surface of the first polishing pad and a plurality of hard polishing materials positioned on the glue layer;

removing portions of the first polishing pad to remove portions of the hard polishing material positioned on the surface of the first polishing pad so as to form a plurality of holes penetrating the first polishing pad;

providing a second polishing pad which comprises a glue layer on a surface of the second polishing pad and a plurality of soft polishing materials adhering to the glue layer;

removing portions of the soft polishing material positioned on the surface of the second polishing pad while retaining the glue layer, and the soft polishing material retained on the surface of the second polishing pad completely matching the holes formed in the first polishing pad; and sticking the first polishing pad on the surface of the second polishing pad so as to form a composite polishing pad;

wherein the surface of the composite polishing pad comprises a pattern formed by the hard and soft polishing materials.

2. The method of claim 1 wherein the pattern on the surface of the composite polishing pad is formed by interlacing the hard and soft polishing materials along an X-axis and Y-axis of the surface of the composite polishing pad.

3. The method of claim 1 wherein the pattern on a surface of the composite polishing pad is formed by respectively arranging hard and soft polishing materials as rings in concentric circles with different radiuses on the surface of the composite polishing pad.

4. The method of claim 1 wherein the pattern on the surface of the composite polishing pad is formed by interlacing hard and soft polishing materials along radial directions on the surface of the composite polishing pad.

5. The method of claim 1 wherein the area ratio of hard and soft polishing materials positioned on the surface of the composite polishing pad is used to adjust removal rate and improve the uniformity of the surface of a semiconductor wafer after being polished.

6. A method of improving the polishing efficiency of a polishing pad, the method comprising:

providing a first polishing pad which comprises a glue layer on a surface of the first polishing pad and a plurality of first polishing materials positioned on the glue layer;

removing portions of the first polishing pad to remove portions of the first polishing material positioned on the surface of the first polishing pad so as to form a plurality of holes penetrating the first polishing pad;

providing a second polishing pad which comprises a glue layer on a surface of the first polishing pad and a plurality of second polishing materials adhering to the glue layer;

removing portions of the second polishing material positioned on the surface of the second polishing pad while retaining the glue layer, and the second polishing material retained on the surface of the second polishing pad matching the holes formed in the first polishing pad; and sticking the first polishing pad on the surface of the second polishing pad so as to form a composite polishing pad;

wherein the surface of the composite polishing pad comprises a pattern formed by the first and second polishing material, so a composite polishing pad has both a good removal rate and polishing ability.

7. The method of claim 6 wherein the hardness of the first polishing material is greater than the hardness of the second polishinq material.

8. The method of claim 6 wherein the hardness of the second polishing material is greater than the hardness of the first polishing material.

9. The method of claim 6 wherein the pattern on the surface of the composite polishing pad is formed by interlacing the first and second polishing material along an X-axis and Y-axis of the surface of the composite polishing pad.

10. The method of claim 6 wherein the pattern on the surface of the composite polishing pad is formed by respectively arranging the first and second polishing materials as rings in concentric circles with different radiuses on a surface of the composite polishing pad.

11. The method of claim 6 wherein the pattern on the surface of the composite polishing pad is formed by interlacing the first and second polishing materials along radial directions of the surface of the composite polishing pad.

12. The method of claim 6 wherein the area ratio of the first and second polishing materials positioned on the surface of the composite polishing pad is used to adjust a removal rate and improve the uniformity of the surface of a semiconductor wafer after being polished.

* * * * *